US005938218A

United States Patent [19]

Chuang

[11] Patent Number: 5,938,218

[45] Date of Patent: Aug. 17, 1999

[54] WALKER AND ROCKING HORSE

[75] Inventor: A-Chueh Chuang, Tainan, Taiwan

[73] Assignee: Chung-Jen Cheng, Tainan, Taiwan

[21] Appl. No.: 09/238,024

[22] Filed: Jan. 26, 1999

[51] Int. Cl.[6] ..... B62B 7/00

[52] U.S. Cl. ..... 280/87.051; 280/87.01; 280/87.021; 280/7.12; 280/7.17; 280/31; 280/30

[58] Field of Search ..... 280/87.051, 87.01, 280/87.021, 7.12, 7.17, 31, 30

[56] References Cited

U.S. PATENT DOCUMENTS 4,822,030 4/1989 Cone ..... 272/70.3
5,564,724 10/1996 Huang ..... 280/87.051

*Primary Examiner*—Christopher P. Ellis
*Assistant Examiner*—Kevin M. McKinley
*Attorney, Agent, or Firm*—Rosenberg, Klein & Bilker

[57] ABSTRACT

A walker and rocking horse includes a base member consisting of two base rods, two pairs of joint sleeves movably fitting around two abutting ends of the two base rods and able to be connected with or disconnected from each other, two parallel supporting rods fixed between a front and a rear side of the base member and having two ends fixed with a position block, and a plurality of position switches combined on the two base rods The position blocks respectively have two position holes located in an angle condition for the position switches to selectably engage either of the two position holes to transform the walker and rocking horse into a walker or a rocking horse for separate use.

1 Claim, 11 Drawing Sheets

WALKER AND ROCKING HORSE

BACKGROUND OF THE INVENTION

This invention relates to a walker and rocking horse, particularly to one possible to be used as a walker, which can be transformed to a rocking horse.

A known conventional walker shown in FIGS. 13 and 14 includes a base member 10, two pairs of front frames 20 and rear frames 30 crossing with each other inclinedly, and a top frame 40 combined together as the main parts.

The base member 10 is a square shape, and a plurality of rollers 101 attached with the base member 10 to roll on the ground. A lateral rod 102 is fixed respectively between two opposite inner sides of the base member 10, and the lower ends of each pair of the front frame 20 and the rear frame 30 are pivotally connected to the two lateral rods 102. The upper ends of the each pair of the front frame 20 and the rear frame 30 are pivotally connected with the top frame 40. The top frame 40 has an opening for a seat 401 to be combined in the opening.

Then the conventional walker may be moved around by a baby or a child sitting on the seat 401, with the feet touching the ground and trying to move the walker in learning to walk. However, the known conventional walker has only one use, limited in its practicality and worthiness.

SUMMARY

The object of the invention is to offer a walker and rocking horse, possible to be used as a walker and a rocking horse by altering its structure easily.

The feature of the invention is a base member consisting of two base rods connected with each other by means of two pairs of joint sleeves connected with each other or disconnected from each other. Two parallel supporting rods provided between a front and a rear side of the base member and having two ends respectively fixed with a position block. Each position block has two position holes located in an angle condition. A plurality of position switches are combined on the two base rods to selectably fit either of the two position holes of the position blocks for transforming the walker and rocking horse into a walker or a rocking horse for separate use.

BRIEF DESCRIPTION OF DRAWINGS

This invention will be better understood by reference to the accompanying drawings, wherein.

DETAILED DESCRIPTION OF THE PREFERRED EMBODIMENT

Figure 1:
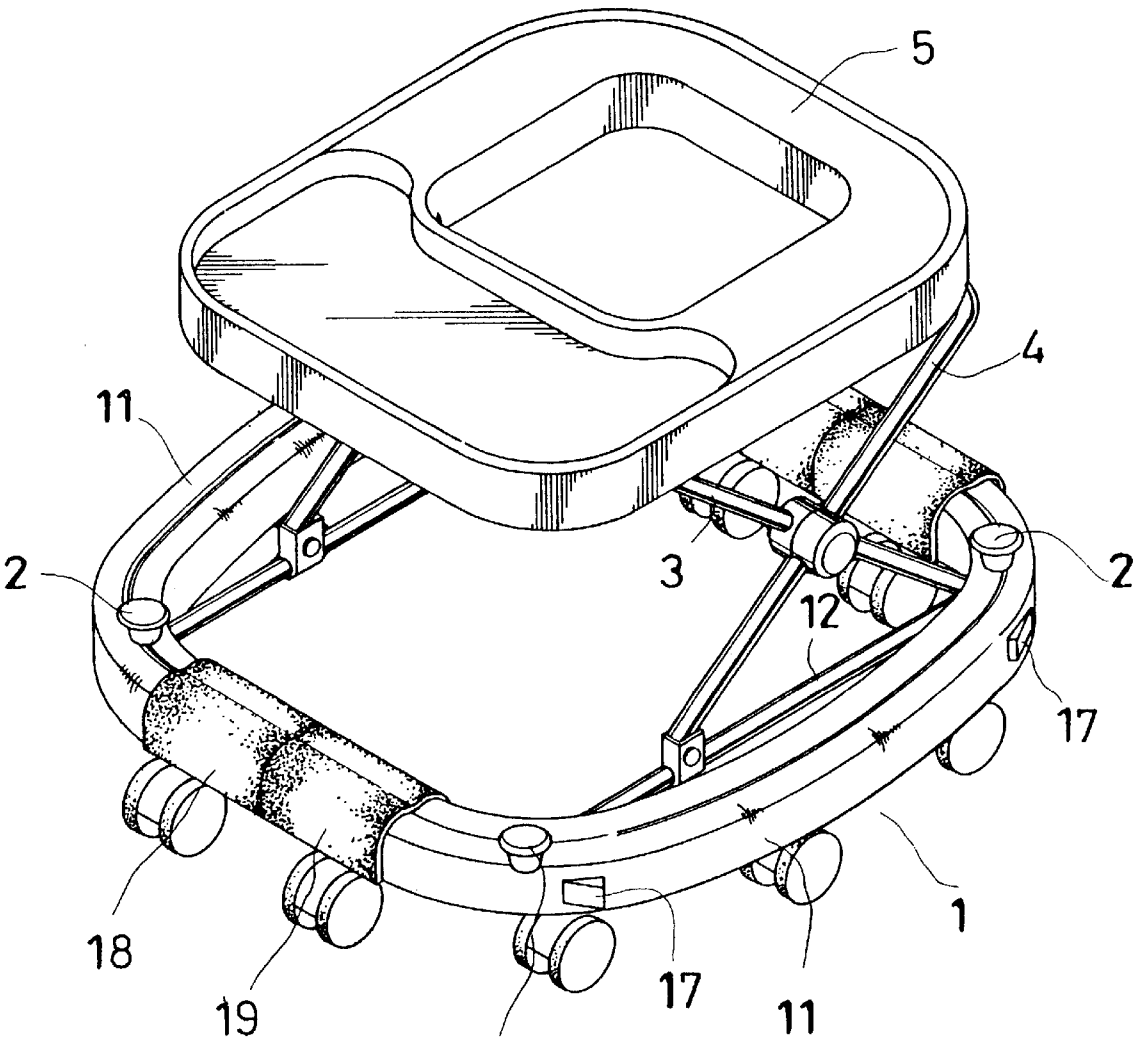
FIG. 1 is a perspective view of a walker and rocking horse of the present invention.
Figure 2:
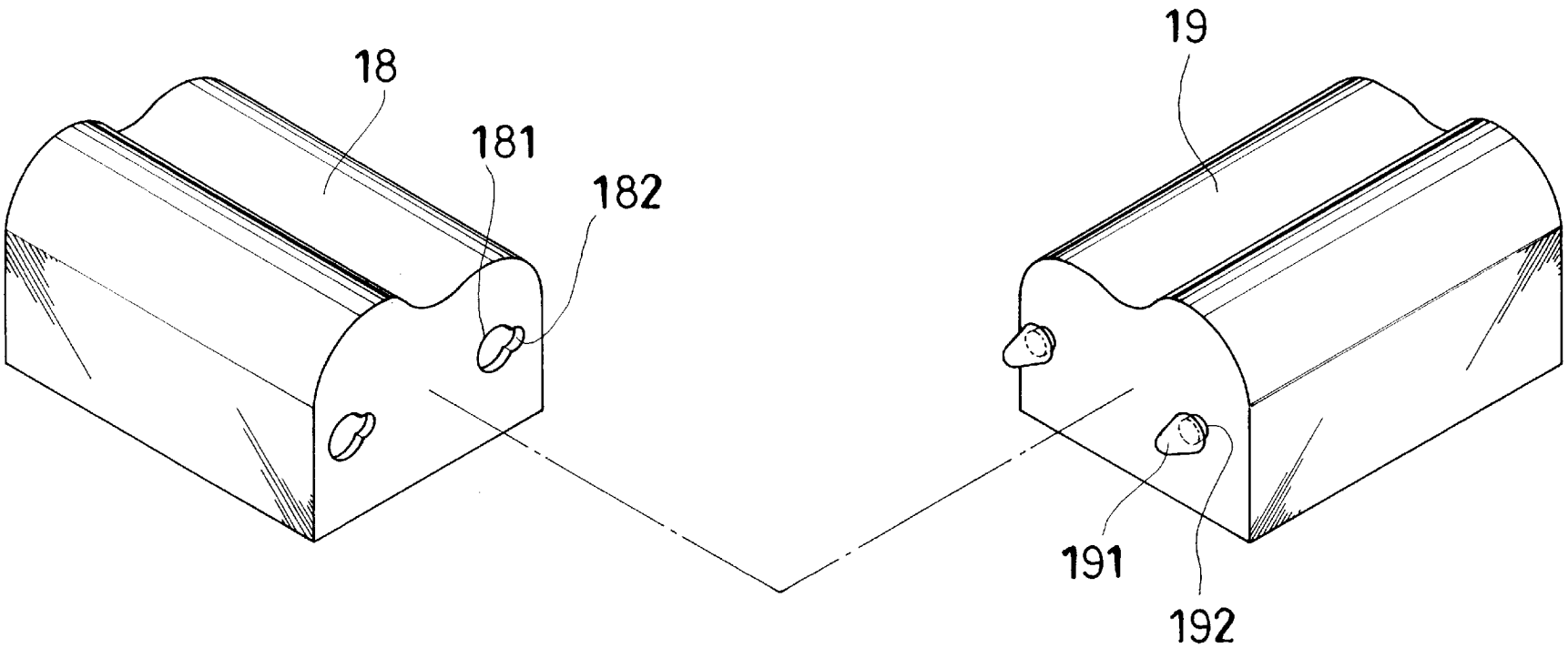
FIG. 2 is a perspective view of a pair of joint sleeves in the walker and rocking horse of the present invention.
Figure 5:
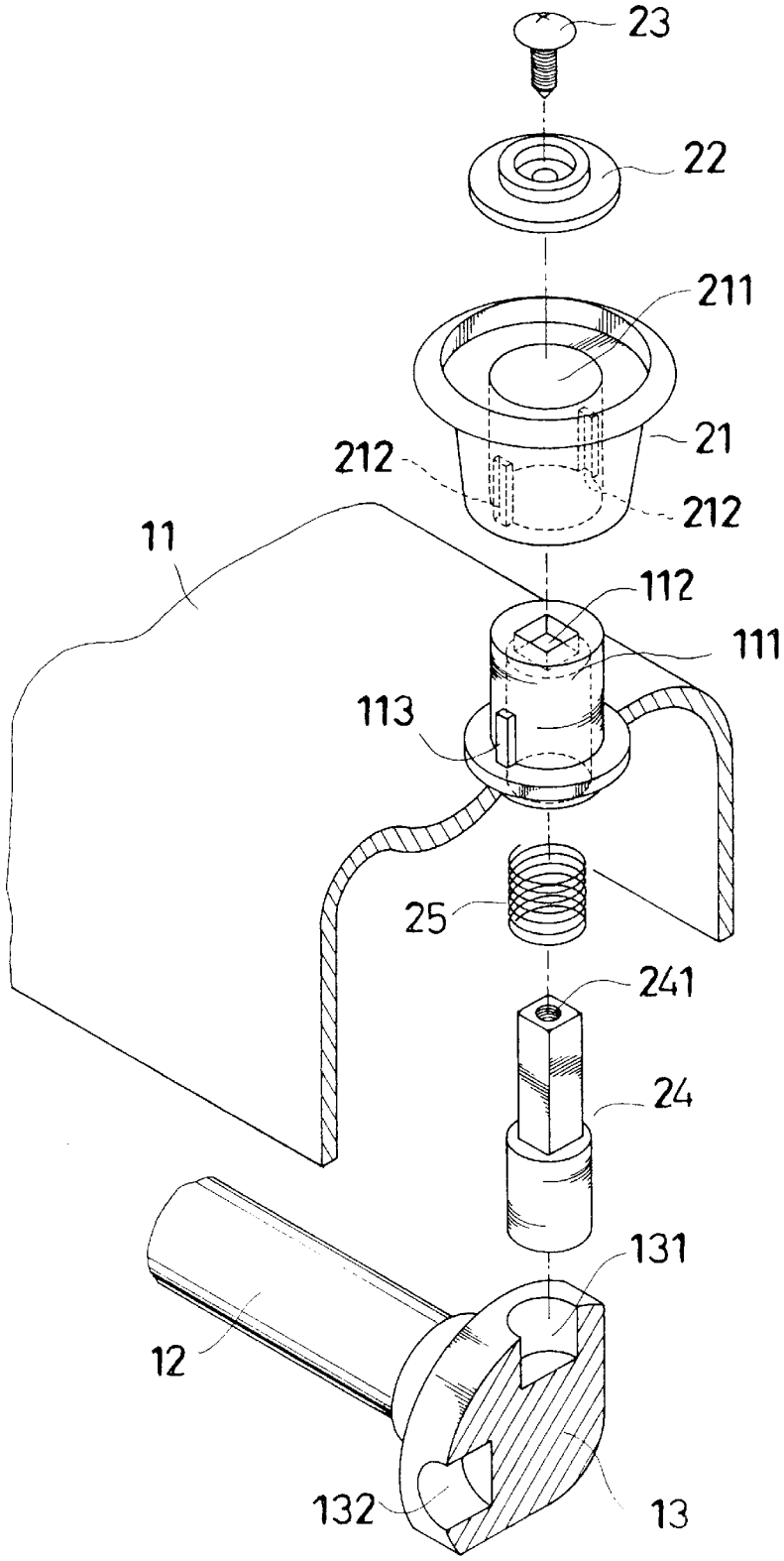
FIG. 5 is a partial exploded perspective view of the walker and rocking horse of the present invention.

A preferred embodiment of a walker and rocking horse of the present invention, as shown in FIGS. 1, 2 and 5, includes a base member 1, a plurality of position switches 2 fixed on two base rods 11 consisting the base member 1, two parallel supporting rods 12 arranged between a front side and a rear side of the base member 1, two pairs of front frames 3 and rear frames 4 crossing with each other inclinedly and having their lower ends pivotally connected with the two parallel supporting rods 12 and their upper ends fixed with an top frame 5.

The base member 1 consists of the two base rods 11 with two curved ends, and each base rod 11 has two ends fixed with a position block 13, which has two position holes 131 and 132 formed in an angle direction. Then a post 111 is fixed on the base rod 11 at a corresponding location of each position block 13, provided with a center cavity 112. The cavity 112 has a multi-side upper end and a circular bottom end, and two opposite vertical projections 113 on the circumferential surface. Further, two threaded rods 14 are provided in an interior of the base rod 11 at two sides of the position block 13. A flat plate 15 closed the bottom opening of the base rod 11 and touches the bottom of the position block 13 with a screw 16 engaging with each threaded rod 14 through the flat plate 15 so that the supporting rod 12 is secured in its position.

Figure 3:
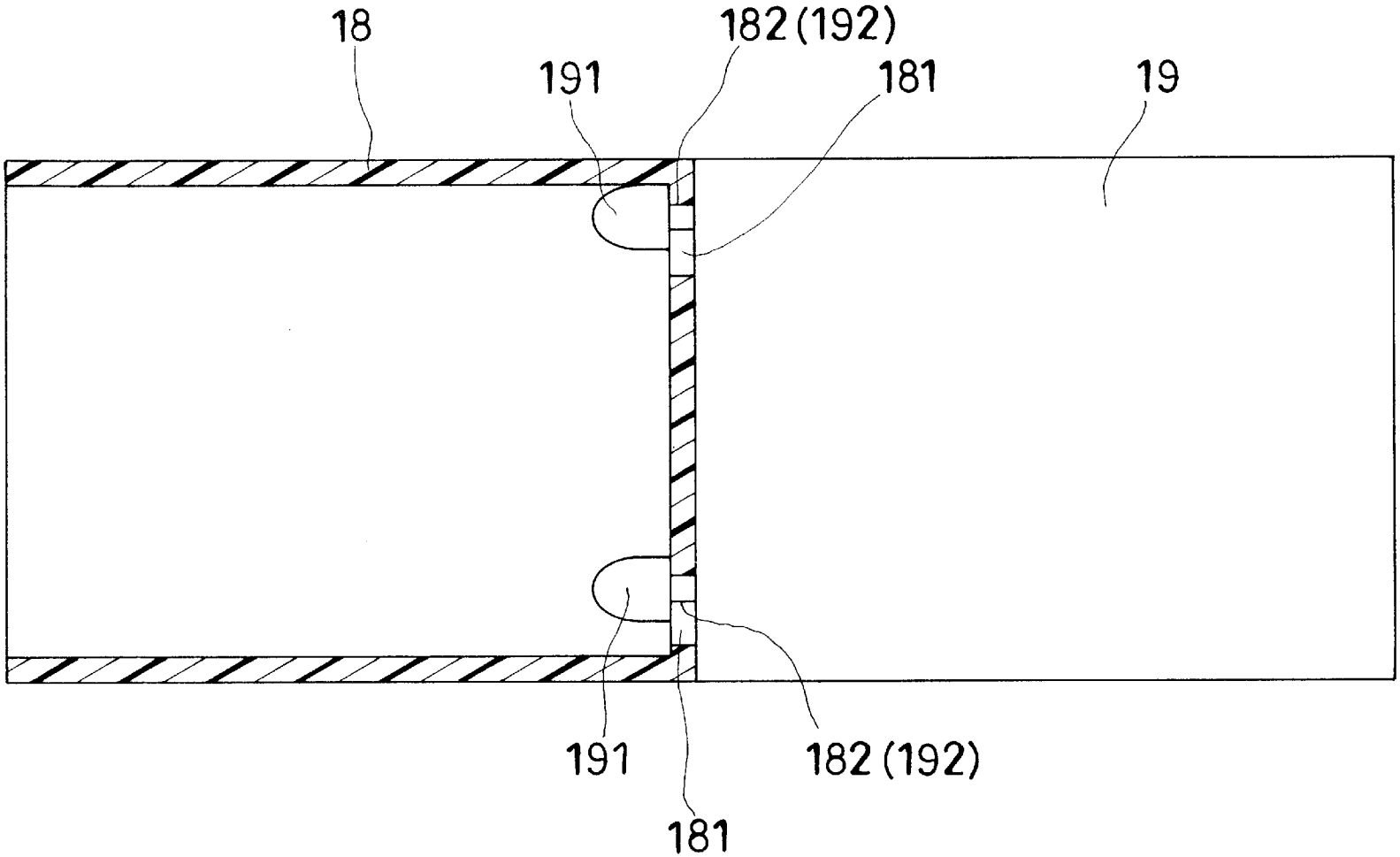
FIG. 3 is a cross-sectional view of the joint sleeves in the walker and rocking horse of the present invention.
Figure 4:
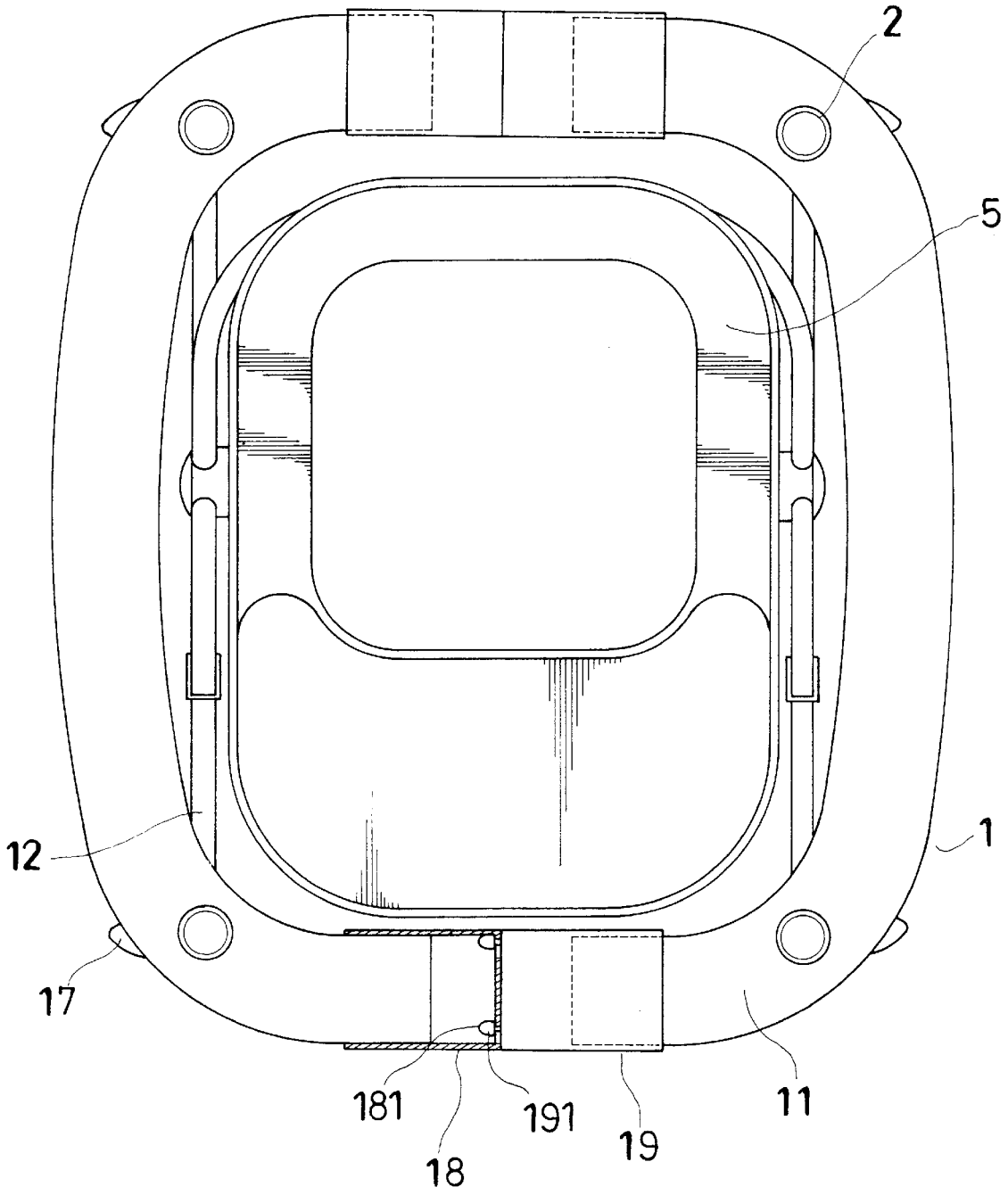
FIG. 4 is an upper view of the walker and rocking horse of the present invention.

Further, two pairs of joint sleeves 18 and 19 are provided, as shown in FIGS. 2 and 3, movably fixed around two abutting ends of the two base rods 11. The first joint sleeve 18 has two position holes 181 in an end surface and two engage holes 182 of a smaller diameter than the position holes 181 formed to communicate with the position holes 181. The second joint sleeve 19 has two position projections 191 with a smaller-diameter inner part 192 on an end surface. The position projections 191 engage the position holes 181 so that the tow joint sleeves 18 and 19 may be connected with each other releasably, as shown in FIG. 4.

Each position switch 2 consists of a pull member 21, a gasket 22, a screw 23, a position post 24 and a coil spring 25 combined together.

The pull member 21 has a center round hole 211 to fit around the post 111, and two opposite vertical grooves 212 formed in a lowr portion of a circumferentail wall of the round hole 211 and engaging with the vertical projections 113 of the post 111.

The gasket 22 is placed on the pull member 21, and the screw 23 passes through the gasket 22 and then engages with a threaded hole 241 of the position post 24 having a lower round portion and an upper multi-side portion, and the coil spring 25 placed in the cavity 112 of the post 111 on the base rod 11.

Figure 6:
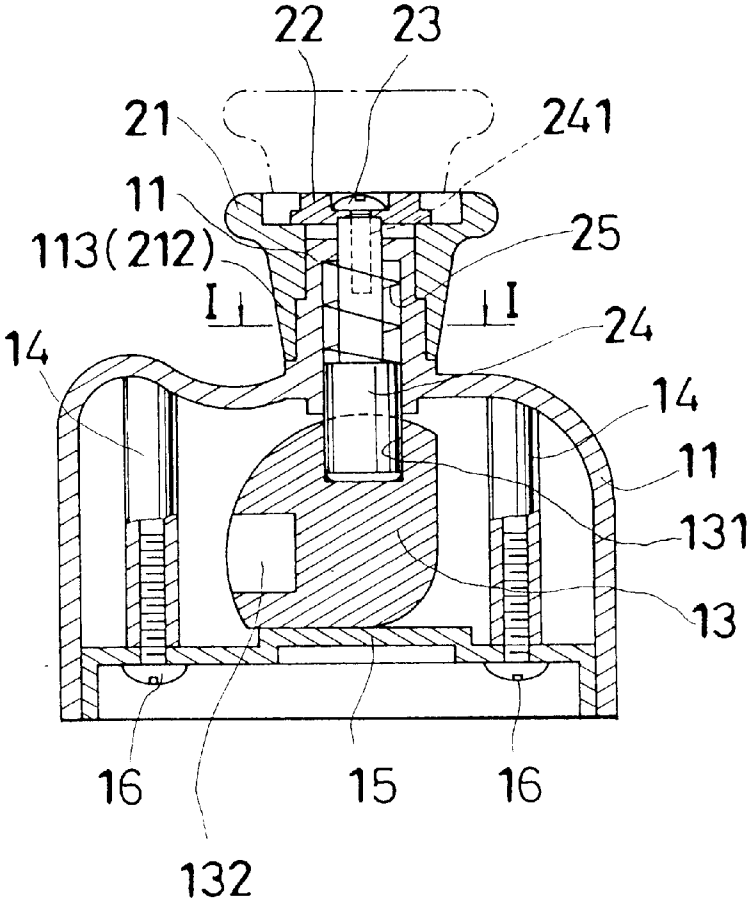
FIG. 6 is a combined cross-sectional view of FIG. 5.
Figure 7:
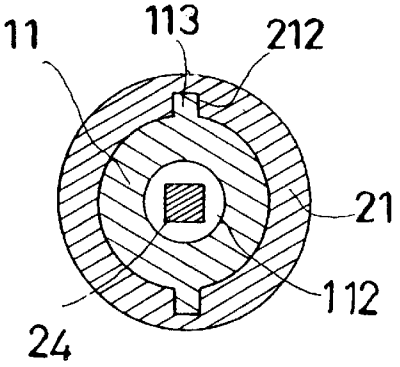
FIG. 7 is a cross-sectional view of line I—I of FIG. 6.

Then the pull member 21 is placed around the post 111, which is thus located in the round hole 211 of the pull member 21 as shown in FIG. 6, with the vertical projections 113 fitting in the vertical grooves 212 as shown in FIG. 7. Next, the coil spring 25 is placed around the upper multi-side portion of the position post 24, then inserted in the cavity 112 of the post 111. Then the gasket 22 is put on the pull member 21, with the screw 23 made to pass through the gasket 22 and then screwed with the threaded hole 241 of the position post 24. Next, the two ends of the supporting rod 12 is arranged to face two postion switches 2, with the screw 16 passing through the bottom plate 15 and engaging with each threaded rod 14, securing the supporting rod 12 in its position.

Normally the base rods 11 have the sides with rollers facing down on the ground, with the walker and rocking horse formed in a walker possible to move around on the ground by a child, and then each position post 24 fits in the first position hole 131 of each position block 13.

Figure 11:
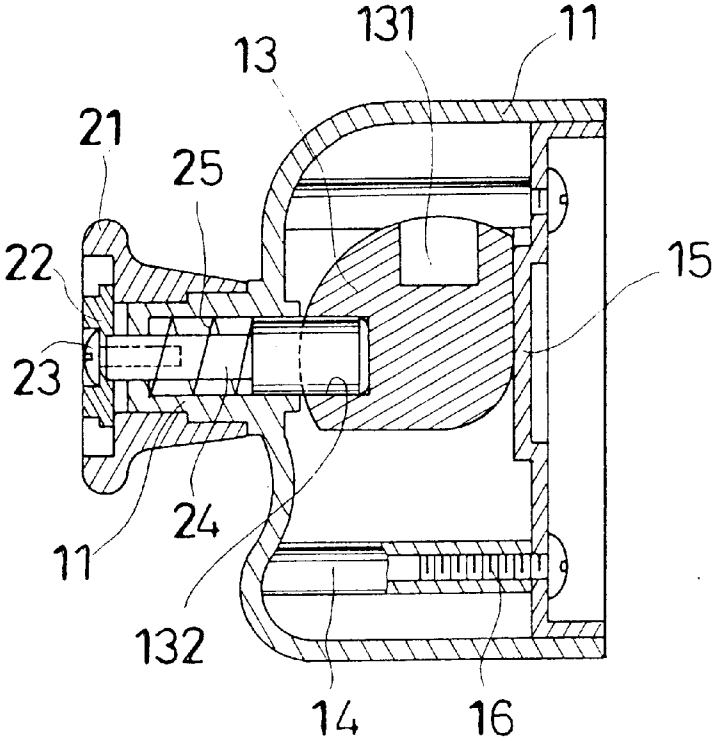
FIG. 11 is a cross-sectional view of a third stage of operation in transforming the walker into the rocking horse.
Figure 10:
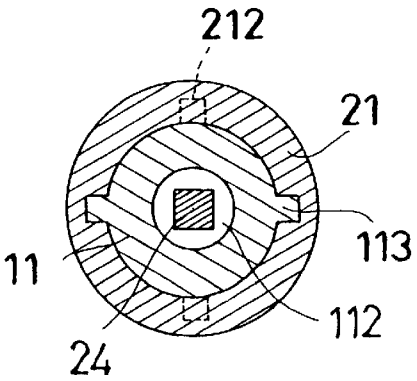
FIG. 10 is a cross-sectional view of line II—II of FIG. 9.
Figure 8:
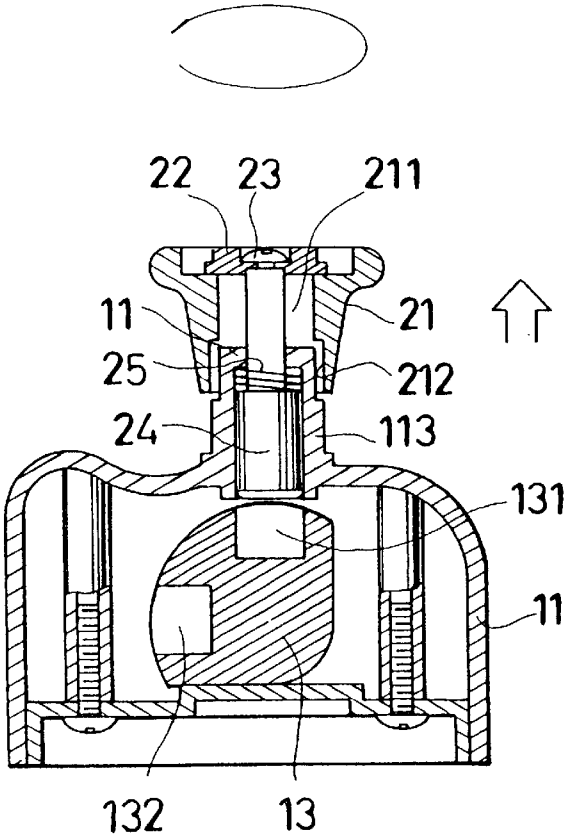
FIG. 8 is a cross-sectional view of a first stage of operation in transforming the walker into a rocking horse.
Figure 9:
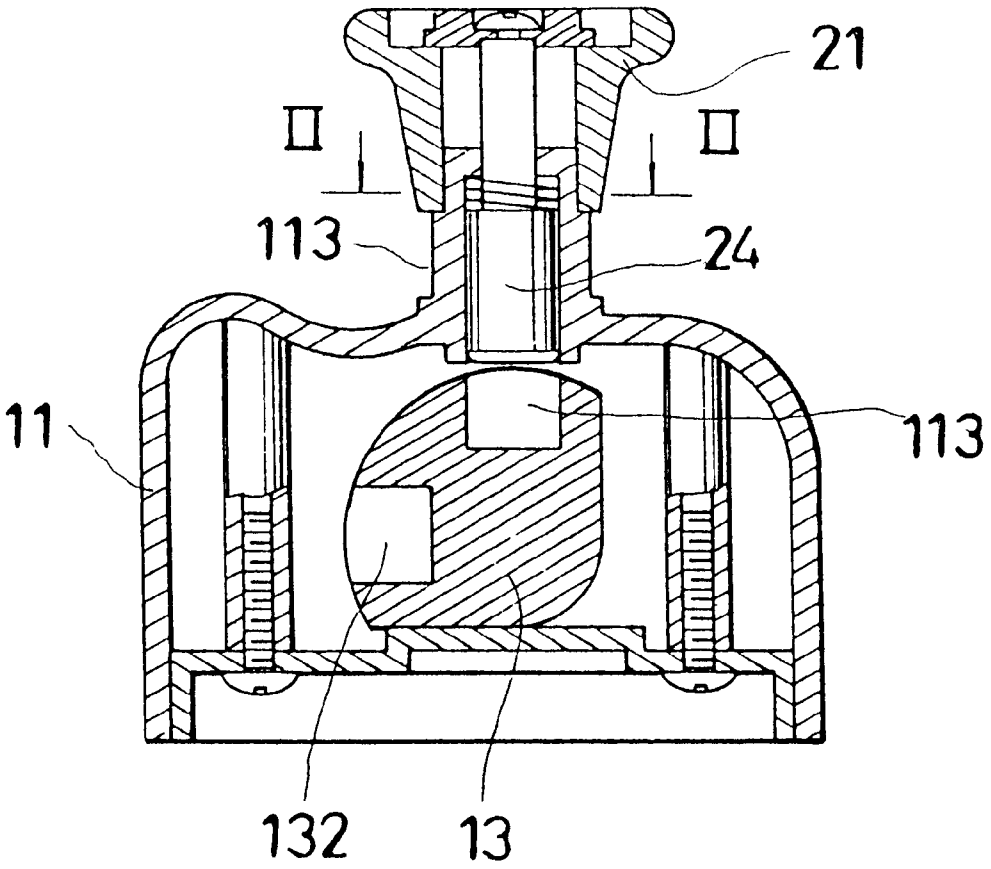
FIG. 9 is a cross-sectional view of a second stage of operation in transforming the walker into the rocking horse.
Figure 12:
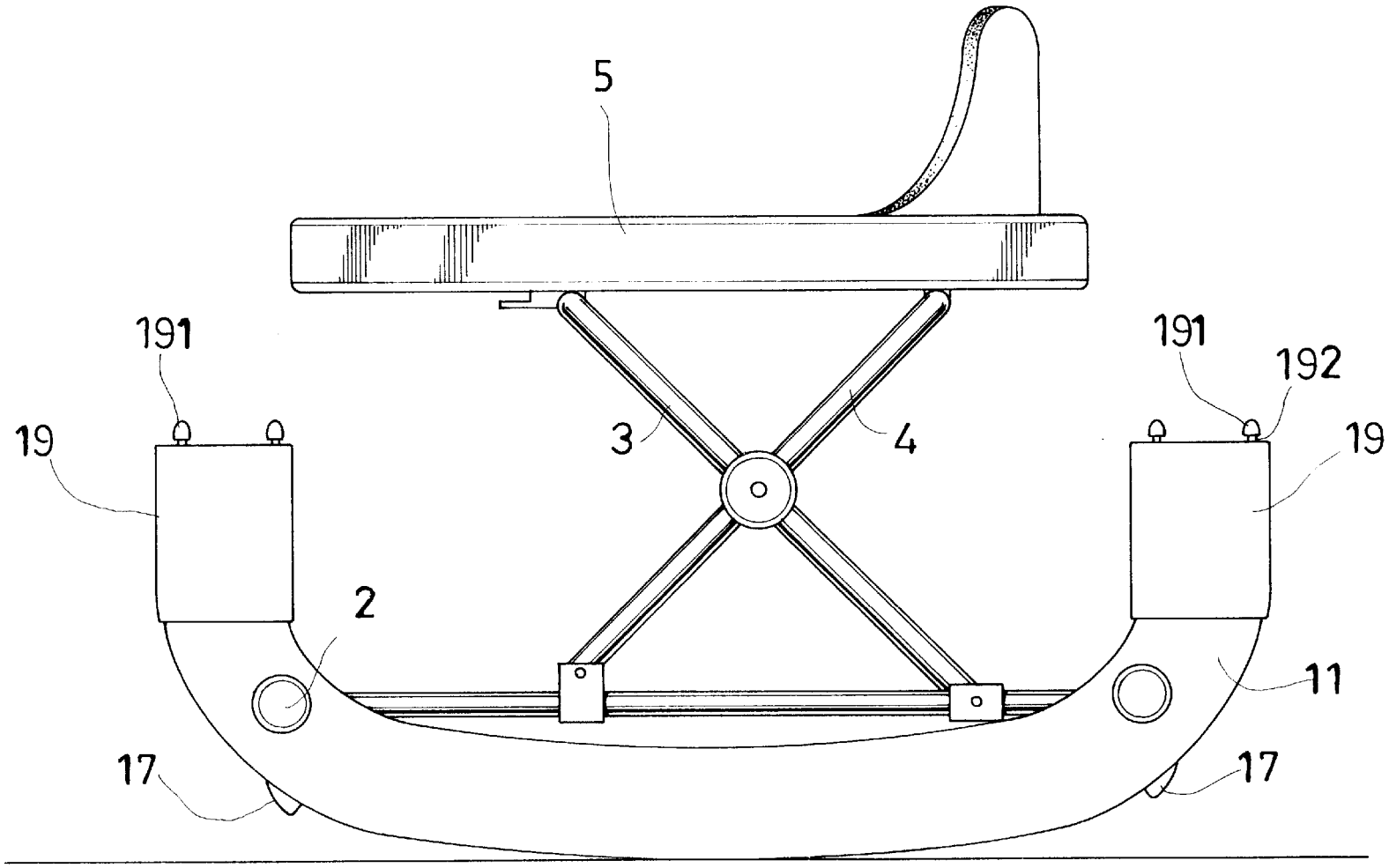
FIG. 12 is a side view of the rocking horse transformed from the walker of the present invention.
Figure 13:
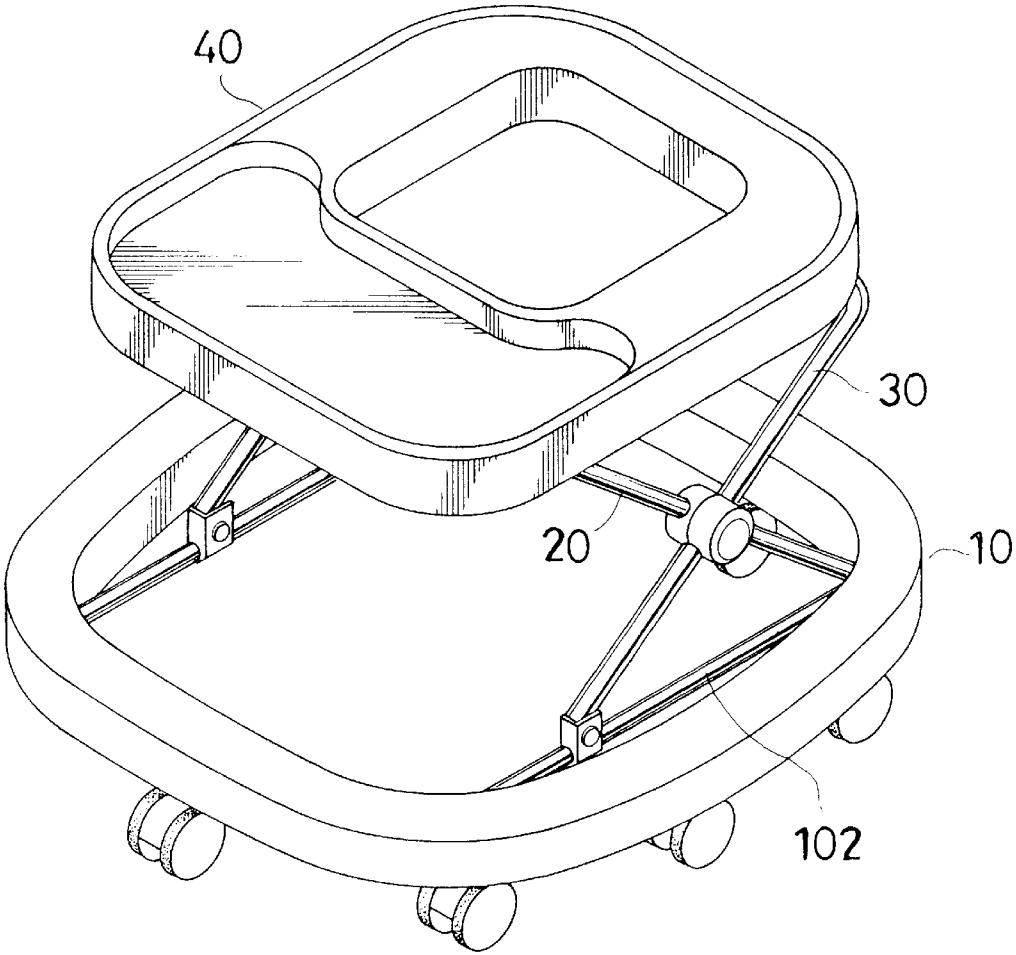
FIG. 13 (PRIOR ART)
FIG. 13 is a perspective view of a known conventional walker.
Figure 14:
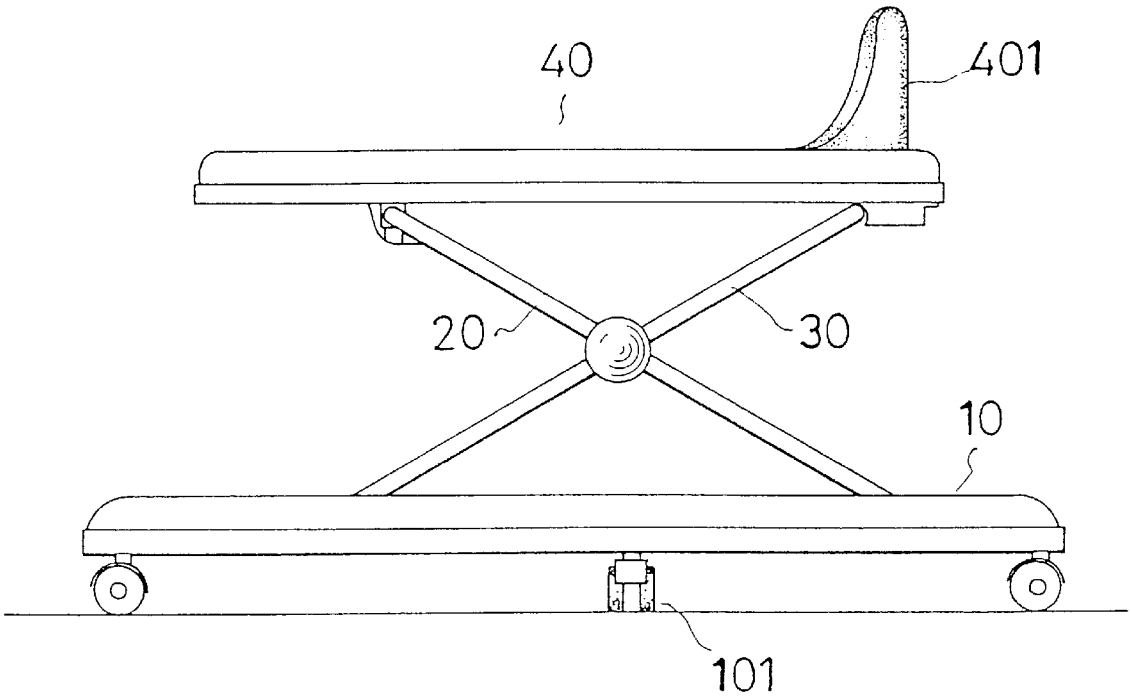
FIG. 14 (PRIOR ART)
FIG. 14 is a side view of the known conventional walker.

If the walker is to be transformed into a rocking horse, the two pairs of the joint sleeves 18 and 19 joined with each other and fixed with the two abutting ends of the two base rods 11 are disconnected from each other, and pushed to make their ends contact the ends of the two base rods 11. Then the pull members 21 are pulled up to let the vertical grooves 212 disengaging from the vertical projections 113, with the upper ends touching the bottom edge of the pull members 21 as shown in FIGS. 9 and 10. When the pull member 21 is moved up, the position post 24 combined with it also moves up and separates from the first position hole 131 of the position block 13. Then the base rods 11 are rotated outward a proper angle, letting the two curved ends facing up. Then the pull member 21 are rotated a proper angle, letting the vertical grooves 212 align to the vertical projections of the posts 111, and then released to let the coil springs 25 recover elasticity and push the pull members 21 and the position posts 24 down, forcing the position posts 24 fitting in the second position holes 132 of the position blocks 13, securing the base rods 11 in their position as the rocking horse as shown in FIG. 11. In addition, stops 17 are respectively attached on each end of each base rod 11 to limit the swinging angle of the rocking horse, as shown in FIG. 12.

Provided the rocking horse is wanted to be transformed into a walker, first, the pull members 21 are pulled up and rotated for a proper angle, forcing the position posts 24 disengaging from the second position holes 132. Then the base rods 11 are rotated to let the rollers attached thereon to stand on the ground, and the pull members are rotated back for a proper angle, letting the coil springs 25 recover their elasticity to force the position posts 24 fit in the first position holes 131. Thus, the base rods 11 are secured in the position of a walker, and then the joint sleeves 18 and 19 are moved inward to engage the postion projections 191 with the position grooves 181, then the smaller-diameter part 192 engaging the engage holes 182 to secure the two joint sleeves 18 and 19 in their position.

What is claimed is:

1. A walker and rocking horse comprising a base member consisting of two base rods, a plurality of position switches provided in said base rods, two parallel rods provided between a front side and a rear side of said base member, two pairs of front frames and rear frames crossing with each other inclinedly, a lower end of each front frame and each rear frame pivotally connected with each said parallel rod, an upper end of each front and each rear frame fixed with a top frame;

characterized by each said parallel rod having two ends each fixed with a position block, each said position block provided with two position holes located in an angle condition, a post fixed on each said base rod at a corresponding location of each said position block and having a cavity, said cavity having a multi-side upper edge and a round lower edge, two opposite vertical projections formed on a circumferentail surface of each said post, two threaded rods provided at two sides of each said position block in an interior of each said base rod, a flat plate closing the interior of each said base rod, two screws passing through said flat plate and engaging with said threaded rods, a stop provided on each end of each said base rod, a pair of joint sleeves movably fitted respectively around two abutting ends of said two base rods, a first joint sleeve having a position hole and an engage hole communicating with said position hole on an end surface, a second joint sleeve having a position projection with an inner smaller-diameter part on an end surface, said two pairs of joint sleeves engaging with each other by means of said position projections engaging said position holes so that said two base rods may be connected with each other securely to form said base member; each said pull member of each said position switch having a center round hole and two opposite vertical projections on a lower portion of said round hole, a gasket covering on said center hole of said pull member, a screw passing through said gasket and engaging with a threaded hole in an upper end of a position post having an upper multi-side portion and lower circular portion, a coil spring placed in said cavity of each said post on each said base rod and fitting around each said position post; and, each said pull member placed to surround each said post on each said base rod, with said post located in said center round hole of said pull member, said vertical projections of each said post engaging said vertical grooves of said center hole of each said pull member, each said position post with each said coil spring fitting around and inserted in said cavity of said post on each said base rod, a gasket covered on each said pull member, a screw passing though each said gasket and engaging with each said threaded hole of each said position post, said two rods having two ends placed to face said position switches, screws passing through said bottom plate and engaging said threaded rods, thus securing said two rods in their position to form a walker and rocking horse.

* * * * *